US008117779B2

(12) United States Patent
Doll et al.

(10) Patent No.: US 8,117,779 B2
(45) Date of Patent: Feb. 21, 2012

(54) CATCHES AND TRIGGER APPARATUS FOR USE WITH WEAPONS

(75) Inventors: Stefan Doll, Oberndorf (DE); Ernst Wössner, Sulz (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 12/771,960

(22) Filed: Apr. 30, 2010

(65) Prior Publication Data

US 2010/0269391 A1 Oct. 28, 2010

Related U.S. Application Data

(63) Continuation of application No. PCT/EP2008/009230, filed on Oct. 31, 2008.

(30) Foreign Application Priority Data

Oct. 31, 2007 (DE) ..... 10 2007 052 105

(51) Int. Cl.
*F41A 3/00* (2006.01)

(52) U.S. Cl. ..... 42/69.01; 42/69.02; 42/69.03

(58) Field of Classification Search ..... 42/69.01–69.03, 42/70.01, 70.04, 70.05, 70.06; 89/148–150, 89/153–154, 27.12
See application file for complete search history.

(56) References Cited

U.S. PATENT DOCUMENTS 949,467 A 2/1910 Prommer
1,907,163 A 5/1933 White
2,397,387 A 3/1946 Trevaskis
2,905,058 A 9/1959 Maillard
4,133,128 A 1/1979 Brush
4,352,317 A 10/1982 Wilhelm (Continued)

FOREIGN PATENT DOCUMENTS

DE 98 218 C 1/1896

(Continued)

OTHER PUBLICATIONS

Patent Cooperation Treaty, "International Search Report and Written Opinion," issued by the International Searching Authority in connection with international counterpart PCT application No. PCT/EP2008/009230, mailed Apr. 28, 2009 , 23 pages.

(Continued)

*Primary Examiner* — Michael Carone
*Assistant Examiner* — Jonathan C Weber
(74) *Attorney, Agent, or Firm* — Hanley, Flight & Zimmerman, LLC

(57) ABSTRACT

Catches and trigger apparatus for use with weapons are described. An example trigger apparatus for use with a firearm having a breech includes a latch moveable between a blocking position that blocks the breech and a non-blocking position that does not block the breech. The latch includes a sear arm, a spring assembly, and a securing element moveable between a first position and a second position. The spring assembly is to bias the securing element. In the first position, the securing element is positioned at a distance from the sear arm and a surface of a securing device in a securing position to enable the latch to be moved to the non-blocking position and the breech to retract relative to the weapon. In the second position, the securing element is positioned adjacent the sear arm via the breech and the surface of the securing device in the securing position to secure the latch in the blocking position.

18 Claims, 9 Drawing Sheets

U.S. PATENT DOCUMENTS

| | | | | |
|---|---|---|---|---|
| 5,339,721 | A | 8/1994 | Beretta | |
| 5,913,261 | A | 6/1999 | Guhring et al. | |
| 6,125,735 | A | 10/2000 | Guhring | |
| 6,640,478 | B2 * | 11/2003 | Johansson | 42/69.02 |
| 6,817,131 | B1 | 11/2004 | Prechtl | |
| 6,907,813 | B2 | 6/2005 | Gablowski | |
| 2004/0194615 | A1 | 10/2004 | Gablowski | |
| 2009/0107024 | A1 | 4/2009 | Doll et al. | |

FOREIGN PATENT DOCUMENTS

| | | | |
|---|---|---|---|
| DE | 10 09 978 | B | 6/1957 |
| DE | 11 29 871 | B | 5/1962 |
| DE | 14 53 917 | A | 9/1969 |
| DE | 10163003 | A | 7/2003 |
| WO | 2009/056176 | A1 | 5/2009 |

OTHER PUBLICATIONS

Patent Cooperation Treaty, "International Preliminary Exam Report with Amended Page," issued by the International Searching Authority in connection with international counterpart PCT application No. PCT/EP2008/009230, mailed Nov. 11, 2009 , 18 pages.

Patent Cooperation Treaty, "International Search Report," issued by the International Searching Authority in connection with international counterpart PCT application No. PCT/EP2008/001365, mailed Aug. 27, 2008, 6 pages.

Patent Cooperation Treaty, "International Preliminary Report Regarding Patentability," issued by the International Searching Authority in connection with international counterpart PCT application No. PCT/EP2008/001365, mailed Nov. 13, 2009, 30 pages.

Patent Cooperation Treaty, "Written Opinion," issued by the International Searching Authority in connection with international counterpart PCT application No. PCT/EP2008/001365, mailed Nov. 13, 2009, 6 pages.

United States Patent and Trademark Office, "Non-Final Office Action," issued in connection with U.S. Appl. No. 12/196,965, on Jun. 18, 2009 (10 pages).

United States Patent and Trademark Office, "Notice of Allowance," issued in connection with U.S. Appl. No. 12/196,965, on Feb. 1, 2010 (7 pages).

United States Patent and Trademark Office, "Examiners Amendment," issued in connection with U.S. Appl. No. 12/196,965, on Apr. 13, 2010 (4 pages).

United States Patent and Trademark Office, "Notice of Allowance," issued in connection with U.S. Appl. No. 12/196,965, on May 24, 2010 (5 pages).

International Bureau, "International Preliminary Report on Patentability," issued in connection with PCT application Serial No. PCT/EP2008/009230, mailed Sep. 10, 2010 (7 pages).

International Bureau, English Translation of the "International Preliminary Report on Patentability," issued in connection with PCT application Serial No. PCT/EP2008/001365, mailed on Sep. 1, 2010 (6 pages).

* cited by examiner

CATCHES AND TRIGGER APPARATUS FOR USE WITH WEAPONS

RELATED APPLICATION

This patent is a continuation of International Patent Application Serial No. PCT/EP2008/009230, filed Oct. 31, 2008, which claims priority to German Patent Application 10 2007 052 105.9, filed on Oct. 31, 2007, both of which are hereby incorporated herein by reference in their entireties.

FIELD OF THE DISCLOSURE

This patent relates generally to catches and trigger apparatus and, more specifically, to catches and trigger apparatus for use with weapons.

BACKGROUND

Turning initially to FIGS. 13 and 14, a known relatively simple trigger mechanism 1300 is depicted that may be used in connection with automatic weapons such as pistols and/or rifles (e.g., machine guns). Automatic weapons are weapons that provide continuous fire.

The trigger mechanism 1300 includes a trigger 1302 that is pivotably mounted below a breech block (not shown) adjacent to or in a handle or hand piece 1304. The trigger 1302 includes a transverse pivot axis 1306 adjacent an upper central region 1308 of the trigger 1302 to enable a rear portion (e.g., a rear upper trigger portion) 1310 to travel in a relatively curved path when the trigger 1302 is actuated. The rear portion 1310 of the trigger 1302 engages and/or acts on a first or front end 1312 of a catch or latch 1314. The catch 1314 may be pivotably coupled and/or mounted about a transverse axis 1316 in a weapons housing and/or the handle piece 1304. A second or rear end 1318 of the catch 1314 is a sear arm 1320.

When the trigger 1302 is swiveled or urged into an idle or neutral position by a spring 1322 toward the front of the weapon, the front end 1312 of the catch 1314 swivels or moves downward and the rear end 1318 of the catch 1314 moves upward along with the sear arm 1320. The catch 1314 may be biased by the spring 1322. As shown in FIG. 13, when the rear end 1318 of the catch 1314 having the sear arm 1320 is positioned in the upward position, the sear arm 1320 is positioned in a locking or blocking position. The trigger 1302 and the catch 1314 may be cushioned and/or pre-stressed by a different or the same spring(s) such as the spring 1322. The spring 1322 may urge the trigger 1302 to a resting position and may urge the catch 1314 to a catching, locking or blocking position.

If a breech block (not shown) is retracted or pulled back from a front resting position, a surface or bottom surface of the breech engages the sear arm 1320. The interaction between the breech and the sear arm 1320 moves the rear end 1318 of the catch 1314 downward as the breech overruns the sear arm 1320. The breech may include a sear catch (not shown) that is configured to interact with the sear arm 1320. In operation, after the sear catch moves across the sear arm 1320, the sear arm 1320 moves (e.g., snaps) upward to be adjacent to and/or engage the sear catch and secure the breech in the rear position. With the sear arm 1320 adjacent to and/or engaging the sear catch, the weapon is tensioned and ready to fire.

If the trigger 1302 is actuated, the sear arm 1320 is lowered until the sear arm 1320 releases the sear catch and, thus, the breech. Releasing the breech causes the weapon to begin firing (e.g., continuously firing). By releasing the trigger 1302, the sear arm 1320 moves upward to the locking or blocking position and enables the sear arm 1320 to engage and retain the breech in a rear position (e.g., the weapon is tensioned and ready to fire). The continuous firing is terminated (e.g., stopped) when the trigger 1302 is released and the breech is retained in the rear position.

In some instances, the safety device is a trigger safety that substantially prevents unintentional activation of the trigger. However, because of acceleration forces, these trigger safeties may not prevent the sear arm 1320 from yielding (e.g., moving out of the locking position) if a loaded, pretensioned machine gun having its trigger safety engaged falls off of a truck, for example.

A safety device 1324 may interact with a safety finger 1326 to fix or secure the catch 1314 and the safety finger 1326 in the locking position (e.g., the blocking position). However, securing the catch 1314 in the locking position, via the safety device 1324, may prevent the breech from retracting over and/or beyond the catch 1314. Additionally or alternatively, because in the locking position the catch 1314 is unable to yield when the safety device 1324 is engaged, the breech may become jammed on the catch 1314 as the breech retracts.

FIG. 13 depicts a surface or peripheral surface 1328 sheltering, engaging and/or interacting with the safety finger 1326 of the catch 1314. A weapon having the safety device 1324 cannot be cocked and/or have the cylinder of the safety device 1324 rotated when the safety device 1324 is secured, for example.

Weapons stations are increasingly including fully automated weapons having trigger mechanisms such as the trigger mechanism 1300, for example. The weapons mounted on gun carriages of the weapons stations may be adjusted via actuators (e.g., electromagnetically controllable actuators). The actuators may interact with and/or act on the trigger 1302 and/or a securing device (e.g., the safety device 1324). To substantially ensure the weapons stations operate in a secure and/or safe manner, if a malfunction occurs (e.g., a power failure), activation of the trigger 1302 is interrupted and/or stopped (e.g., the actuator stops impacting the trigger 1302) and the securing device (e.g., the safety device 1324) is set on safety (e.g., the actuator moves the safety device 1324 into the safety position) regardless of the state of the weapon.

If the catch 1314 is secured in the locking position, the breech may be prevented from retracting and/or the cylinder may not be rotated. Additionally or alternatively, as shown in FIG. 14, high forces of the actuator used to move the safety device 1324 to the safety position may engage and jam (e.g., retain) the safety finger 1326. This engagement between the safety device 1324 and the safety finger 1326 may prevent the sear arm 1320 from moving upward to engage the sear catch and retain the breech in the rear position. If the breech is unretained, the weapon will continuously fire even if activation of the trigger is interrupted (e.g., stopped).

For example, with the trigger activated and the breech moving toward the front of the weapon, a power failure (e.g., a malfunction) may simultaneously initiate the release of the trigger and the respective actuator to move the safety device 1324 to the safety and/or securing position. When the catch 3114 is positioned in the releasing position, the safety finger 1326 is positioned in a safety recess 1402 (FIG. 14) of the safety device 1324 and substantially blocks or prevents the safety device 1324 from moving into the safety position. After a malfunction, as the safety device 1324 moves toward the safety position, a surface of the safety recess 1402 may engage and hold the safety finger 1326 in the unlocked position against the biasing force of the spring 1322. The engagement of the safety finger 1326 by the safety recess 1402 may prevent the sear arm 1320 from moving to the locking and/or blocking position. The sear arm 1320 does not retain the breech when in the unlocked position and, thus, the breech moves back and forth firing the weapon until the ammunition supply is exhausted (e.g., interrupted).

DE 101 63 003 A1 and US 2004/0194615 A1 or US 6,907,813 B2 describe trigger devices including sear arms that are pivotable on a catch. As the breech moves toward the rear of the weapon, the sear arm is swiveled against the force of a spring from a blocking position to an unblocking position (e.g., swerving position). In the unblocking position, the breech is able to overrun and/or travel over the sear arm. As the breech then moves toward the front of the weapon, the spring urges the sear arm upward into the sear catch and is there retained and/or held in the blocking position by the breech block. The sear arm includes a securing or safety element that cooperates and/or interacts with a securing device (e.g., the safety device 1324 or safety roller) to enable the securing device to be moved to the secured or safety position regardless of the position of the breech block or the position of the catch. The securing device can act on and/or affect both the trigger and the catch.

The trigger device includes an additional spring element to ensure the locking function. To retain the breech, the sear arm and a swivel suspension or pivotal coupling of the sear arm must absorb and/or accept the full force of the forward traveling (e.g., advancing) breech block. The sear arm and the corresponding swivel suspension may be relatively small and may be exposed to relatively high dynamic forces. If the sear arm, the swivel suspension and/or the spring element malfunction or fracture, the weapon may continue to fire until the ammunition runs out independent of the position of the safety mechanism and the trigger. The spring force of the spring element affecting the catch must be precisely adjusted to ensure that the breech block overrunning and/or traveling over the sear arm does not also press the catch downward into the handle piece. If the spring force is not precisely adjusted, the securing element with the safety roller may be impaired and/or damaged.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples described herein relate to example catches for example trigger mechanisms. The example catches may be positioned in a handle piece of a firearm (e.g., an automatic weapon) having a breech block and a securing device and may be moveable between a blocking position and a non-blocking position. In the blocking position, the example catches described herein block and/or retain the breech block in the rear position. In the non-blocking position, the example catches described herein may not block and/or retain the breech block.

Figure 1:
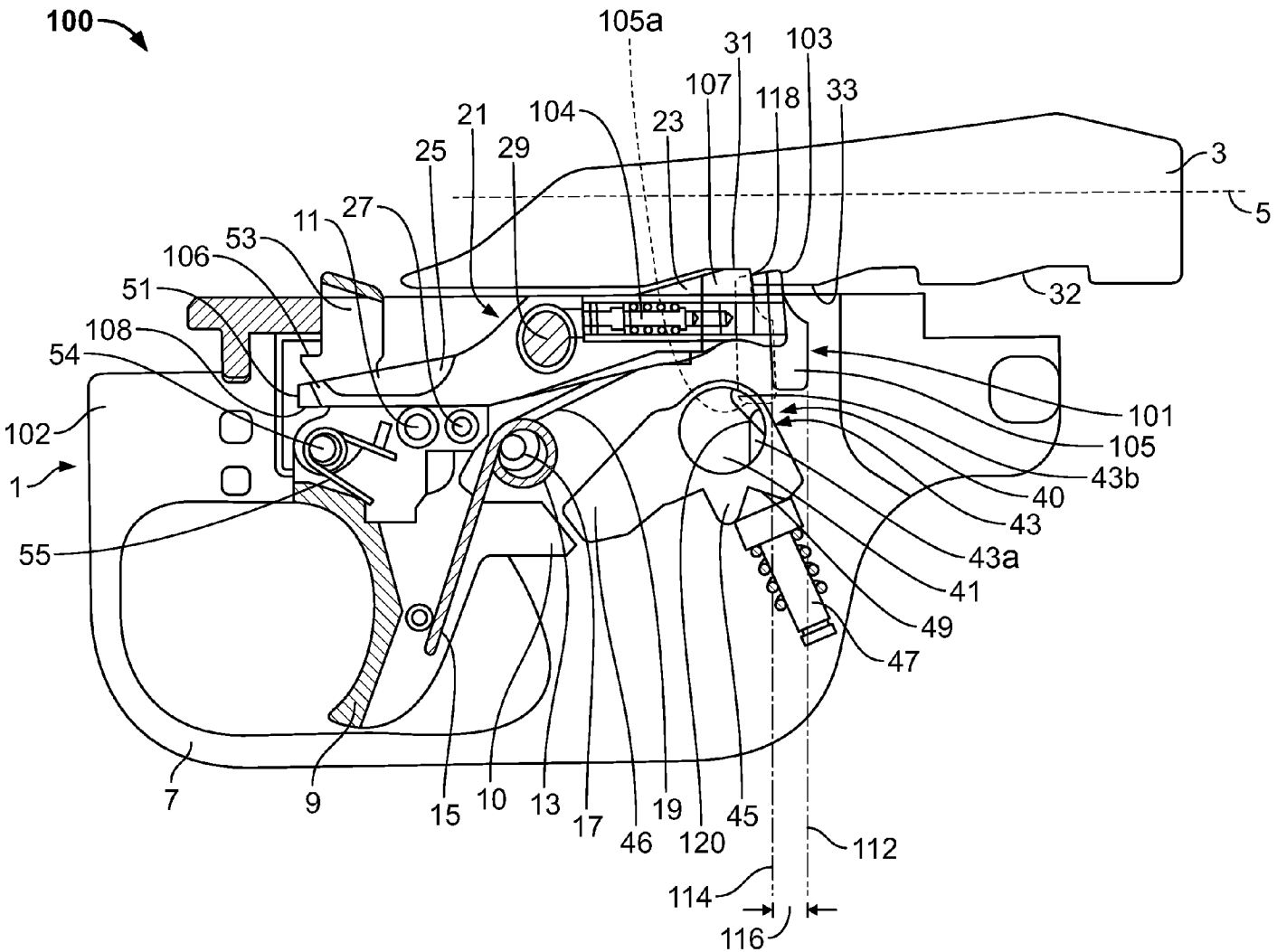
FIG. 1 depicts an example trigger apparatus.

FIG. 1 depicts an example trigger device, mechanism or apparatus 100. The trigger apparatus 100 may include a handle or hand piece 1 mounted in a housing (not shown) of a weapon. A breech block 3 is partially depicted in FIG. 1 and is moveable along an axis of a bore 5.

A trigger guard 7 is positioned adjacent a front end 102 of the handle piece or housing 1. A trigger 9 extends into the trigger guard 7 from the handle piece 1 and is pivotable about a trigger axis 11 in the handle piece 1. The trigger axis 11 may be positioned substantially transverse to the axis of the bore 5. A spring (e.g., a torsion spring) 13 having an upper spring leg or portion 19 and a lower spring leg or portion 15 is positioned at least partially within the handle piece 1. The spring legs 15 and 19 at least partially surround and/or encompass a cross pin 17 to fix and/or secure the spring 13 in the handle piece 1. The lower spring leg 15 biases the trigger 9 to a forward position. The upper spring leg 19 biases a first or rear portion (e.g., a rear lever arm) 23 of a catch or latch (e.g., a two-arm catch, a two-portion catch, a multi-component catch) 21 counterclockwise toward a blocking and/or locking position. A second or front portion (e.g., a front lever arm) 25 of the catch 21 is positioned adjacent to the trigger axis 11 and a release or trigger roller 27. The release roller 27 is seated and/or disposed on and/or adjacent to the trigger 9. The catch 21 is pivotable on and/or about a lever axis 29. The lever axis 29 may be transverse to the axis of the bore 5.

If the trigger 9 is actuated, the trigger 9 moves counterclockwise against a spring force of the spring 13. As the trigger 9 moves counterclockwise, the release roller 27 interacts with and/or engages and raises the front portion 25 of the catch 21 against the spring force of the spring 13 and lowers a first or rear end or securing part 107 of the rear portion 23 (illustrated in FIG. 4 in connection with another one of the examples described herein). A sear arm 31 is positioned adjacent to the rear end 107 of the rear portion 23. As illustrated in FIG. 1, the sear arm 31 interacts with and/or engages a sear catch 33 defined by the breech block 3 to retain the breech block 3 in the rear position (e.g., cocked and ready to fire position). If the trigger 9 is actuated (e.g., moved), thereby lowering the sear arm 31 and releasing the breech block 3, the breech block 3 moves forward in and/or relative to the weapon housing under the influence of a spring (e.g., a breech block spring) (not shown) (illustrated in FIG. 4 in connection with another one of the examples described herein). As the breech block 3 moves forward, ammunition is fed into a cartridge chamber and, thereafter, propellant contained therein is ignited via a firing pin (no shown).

When the rear portion 23 of the catch 21 is lowered, the front portion 25 raises and a latching catch 51 of the catch 21 interacts with and/or engages a surface or step 106 of a release catch 53. Specifically, a surface or lower surface 108 of the latching catch 51 interacts with and/or is gripped by the surface 106 of the release catch 53. The release catch 53 is pivotably suspended and/or coupled to the trigger 9 about a pin 54 and is biased by a spring (e.g., a catch spring) 55. After the trigger 9 is released, the interaction between the release catch 53 and the front portion 25 holds, secures and/or positions the rear portion 23 and the sear arm 31 of the catch 21 in a non-blocking position and, thus, outside the breech block 3 path (illustrated in FIG. 5 in connection with another one of the examples described herein).

When the breach block 3 returns toward the rear of the weapon, the breech block 3 engages the release catch 53, thereby moving and/or swiveling (e.g., pivoting) the release catch 53 clockwise against a biasing force of the spring 55. When the release catch 53 pivots clockwise, the latching catch 51 of the catch 21 is released and then moves counter-clockwise (e.g., under the affect of the spring 13) such that the rear portion 23 of the catch 21 is positioned in the breech block 3 path (illustrated in FIG. 6 in connection with another one of the examples described herein). As the breech block 3 returns toward the rear of the weapon, the sear catch 33 of the breech block 3 overruns the sear arm 31, thereby lowering (e.g., elastically lowering) the rear portion 23 of the catch 21 into the handle piece 1 (illustrated in FIG. 7 in connection with another one of the examples described herein). When the fowardmost sear catch 33 is adjacent to and/or has overrun the sear arm 31, the sear arm 31 moves upward into the blocking position to engage and/or be adjacent to the sear catch 33. The interaction between the sear arm 31 and the sear catch 33 retains the breech block 3 in the rear position.

The trigger apparatus 100 of the example illustrated in FIG. 1 includes a slide, portion or securing or actuating element 101 positioned adjacent to the rear end 107 of the rear portion 23. A surface, rear abutting surface or first actuating element 103 of the slide 101 is configured as an actuating element that may be engaged by and/or interact with the sear catch 33. The slide 101 is movable in a direction of an axis of the bore 5 between a first position (e.g., an idle or releasing position) 112 and a second position (e.g., a safety, safe or securing position) 114. A biasing apparatus and/or spring arrangement 104 positioned at least partially within the interior of the rear portion 23 biases the slide 101. In the first position 112, the spring arrangement 104 extends the slide 101 from the rear portion 23 toward the rear of the weapon a distance represented by reference numeral 116.

The interaction between the sear catch 33 and the first actuating element 103 of the slide 101 overcomes the biasing force exerted by the spring arrangement 104 and moves the slide 101 a distance represented by reference number 116 into the second position 114. In the second position 114, the first actuating element 103 is positioned adjacent to and/or ends with a rear abutting surface or surface 118 of the sear arm 31 such that the actuating element (e.g., the slide 101 and/or the first actuating element 103) is positioned substantially completely within a profile of the sear arm 31. When the sear arm 31 is positioned in the blocking position, an interaction between the surface 118 and the breech block 3 (e.g., the sear catch 33 of the breech block 3) substantially prevents the breech block 3 from further moving toward the front of the weapon (illustrated in FIG. 1 and in FIGS. 2 and 3 in connection with another one of the examples described herein). Additionally, because the slide 101 is positioned in the second position 114 when the surface 118 is interacting with the breech block 3, as the breech block 3 moves to engage the catch 21, the slide 101 itself may only be slightly strained by the breech block 3 (e.g., slightly strained by the advancing or adjoining breech block 3). The load imparted on and/or of the slide 101 results from the biasing and/or restoring force of the spring arrangement 104 that is overcome by the advancing breech block 3. The load (e.g., the essential load) and/or stress from the breech block 3 is experienced by the sear arm 31 and/or the catch 21. Such an approach of focusing the load and/or stresses imparted by the breech block 3 to the sear arm 31 and/or the catch 21 as opposed to the slide 101, reduces the risk that the slide 101 will be damaged (e.g., overloaded) and/or malfunction.

The slide 101 includes a finger, securing part or extension 105 that extends from the actuating element (e.g., the first actuating element 103). The finger 105 is associated with a securing part and interacts with a securing or safety device 40. The securing device 40 includes a safety roller 41 having a recess 43. A latching lug or lug 45 and a lever (e.g., an actuating lever) (not shown) are rotationally fixed and/or coupled to the safety roller 41. Utilizing the lever, the safety roller 41 may be moved (e.g., rotated) between a safety position and a firing position. The safety position and the firing position are defined by two recesses 49 on the latching lug 45 and a spring loaded catch apparatus (e.g., a stationary spring loaded catch arrangement) 47. Each of the spring loaded catch apparatus 47 is to engage one of the two recesses 49.

The latching lug 45 includes a safety lug 46. When the securing device 40 is in the safety position (illustrated in FIG. 1), the safety lug 46 is positioned adjacent to a safety extension or extension 10 that extends from the trigger 9 toward the rear of the hand piece 1.

As described below, the finger 105 of the slide 101 interacts with the securing device 40.

When the weapon is cocked (e.g., the breech block 3 is secured in the rear position) and the weapon in the safety position, the breech block 3 adjoins, engages and/or is positioned adjacent to the surface 118 of the sear arm 31 and the first actuating element 103 is positioned in the second position 114. When the slide 101 is positioned in the second position 114 and the safety roller 41 is in the safety position (designated by 43A), the finger 105 may be positioned in an active area of the securing device 40 and an active area 105*a* of the finger 105 may engage and/or interact with a peripheral surface or area 120 of the safety roller 41. When the slide 101 is in second position 114 and the safety roller 41 is in the safety position (designated by 43A), the interaction between the slide 101 and the safety roller 41 substantially supports the rear portion 23 of the catch 21 preventing the rear portion 23 from lowering. The support provided by the interaction between the slide 101 and the safety roller 41 substantially ensures that the sear arm 31 does not move from the blocking position even if the additional trigger safety provided by the interaction between the safety lug 46 and the safety extension 10 is omitted and the trigger 9 is actuated (e.g., pressed).

If the securing device 40 is moved to the firing position by rotating the safety roller 41, for example, the recess 43 is then in the firing position (designated by 43B) and the recess 43 is adjacent to and/or in the region of the finger 105. The safety lug 46 is then at a distance from (e.g., outside an active area of) the safety extension 10 (illustrated in FIG. 3 in connection with another one of the examples described herein).

If the securing device 40 is in the firing position and the trigger 9 is actuated, the release roller 27 urges the front portion 25 of the catch 21 to move (e.g., upward) clockwise and the rear portion 23 along with the sear arm 31 and the slide 101 to move (e.g., swivel downward) into the handle piece 1. By lowering the rear portion 23, the sear arm 31 and the slide 101, the finger 105 enters and/or is positioned adjacent to the recess 43 and the breech block 3 is released. Releasing the breech block 3 enables the breech block 3 to move forward relative to the weapon (illustrated in FIG. 4 in connection with another one of the examples described herein).

Figure 5:
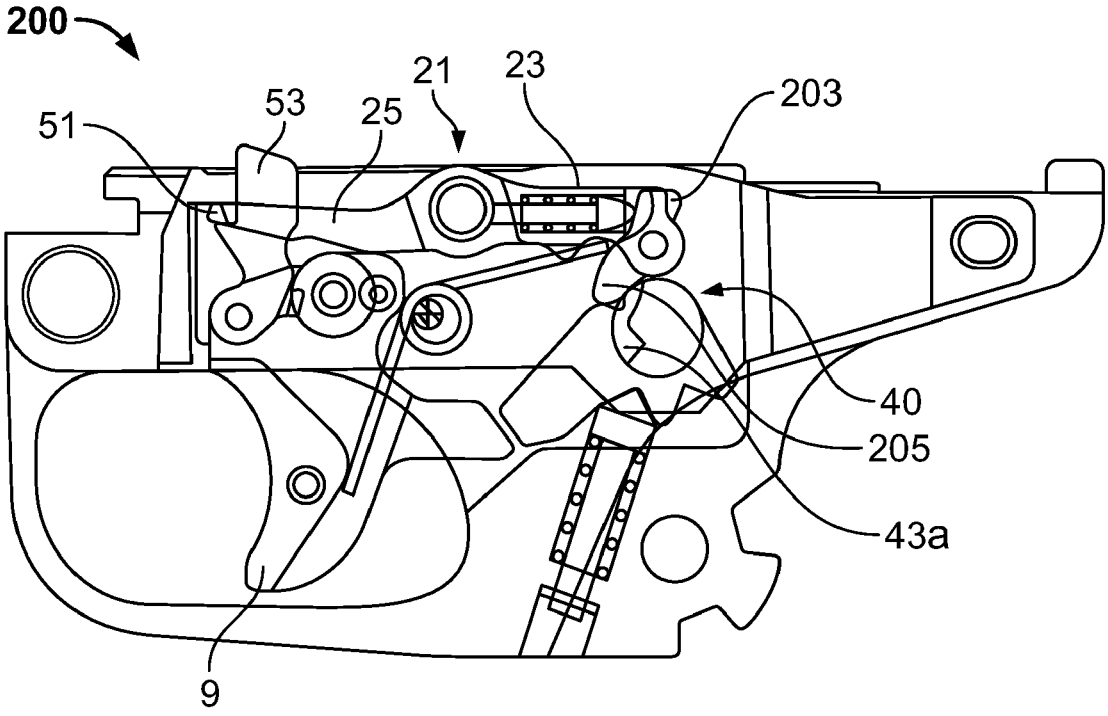

The latching catch 51 interacts with and/or is caught by the release catch 53 to enable the catch 21 and the sear arm 31 to remain substantially within the handle piece 1 when the front portion 25 is raised by actuating the trigger (e.g., released) (illustrated in FIG. 5 in connection with another one of the examples described herein).

When the rear portion 23 is lowered, the slide 101 may be positioned in the first position 112 in which the first actuating element 103 extends from the rear end 107 of the sear arm 31 and the finger 105 is positioned outside of and/or at a distance from the active area of the securing device 40 (the first position 112 is illustrated drawn through in FIG. 1).

During a firing cycle of a weapon, the breech block 3 moves forward feeding a cartridge (e.g., a round) into the cartridge chamber (not shown). The cartridge is thereafter ignited, firing the round, and causing the breech block 3 to return toward the rear of the weapon. As the breech block 3 moves toward the rear of the weapon, the breech block 3 engages the release catch 53 and the latching catch 51 is released. The rear portion 23 of the catch 21 then moves upward biased by the upper spring leg 19. As the breech block 3 overruns and/or moves over the rear portion 23, the rear portion 23 is moved downward via an interaction with one or more corresponding contact members (e.g., oblique contact members) 32 of the breech block 3. The contact members 32 may be positioned somewhat obliquely relative to an edge of the sear catch 33. As the breech block 3 is retracted, the breech block spring (not shown) is cocked (e.g., compressed) until the movement of the breech block 3 reverses (e.g., the breech block 3 begins to again move toward the front of the weapon). The sear catch 33 then engages the surface 118 of the sear arm 31 after moving the slide 101, via the first actuating element 103, into and/or adjacent to the rear portion 23.

If a malfunction occurs (e.g., a misfire, a malfunction when the breech block 3 is advancing and/or retracting, etc.), the breech block 3 may not fully retract and instead may be positioned (e.g., jammed) between the cartridge chamber and the trigger arrangement, for example. If this type of malfunction occurs, the securing device 40 may be actuated (e.g., moved from the firing position to the safety position), because the slide 101 has not been actuated by the sear catch 33 and, thus, is positioned in the first position 112 and the finger 105 is outside of and/or at a distance from the active area of the safety roller 41.

To clear and/or remedy the malfunction (e.g., the jam), the breech block 3 may be manually returned (e.g., cocked while having the securing device 40 and/or the safety roller 41 rotated to the safety position). As the breech block 3 is returned (e.g., racked), the breech block 3 engages the release catch 53 releasing the latching catch 51 and enabling the rear portion 23 along with the sear arm 31 to move upward into the breech block 3 path. The breech block 3 may be returned to the rear position when the securing device 40 is in the safety position because the slide 101 and the finger 105 are in the first position 112 and, thus, outside of and/or at a distance from the active area of the securing device 40. In the first position 112, the rear portion 23 of the catch 22 may be lowered by the returning breech block 3 and the safety roller 41 may be moved (e.g., rotated) between the firing position and the safety position, for example.

After the breech block 3 is returned to the rear position, the sear catch 33 engages the sear arm 31 after moving the slide 101 from the first position 112 to the second position 114. When in the second position 114, the finger 105 is positioned in and/or adjacent to the active area of the securing device 40 and the weapon is then in a secured stated (illustrated in dashed lines in FIG. 5 in connection with another one of the examples described herein).

With the weapon secured, activities and/or tasks may be accomplished without the risk that the weapon will accidentally fire (e.g., the breech block 3 being released because the trigger 9 is accidentally actuated).

The slide 101 is moveable relative to the sear arm 31 to enable the finger 105 to engage at least a portion of the securing device 40. The configuration of the slide 101 enables a person to be able to rack (e.g., retract) the breech block 3 while having the weapon in a secured state (e.g., a safety position), because the finger 105 is at a distance from the active area of the securing device 40 (e.g., the first position 112) until the sear catch 33 moves the slide 101 to the second position 114. In the second position 114, the slide 101 and/or the first actuating element 103 is substantially flush with the surface 118 of the sear arm 31 and the sear catch 33 then engages the sear arm 31. Additionally or alternatively, the weapon may be secured in any state. For example, the weapon may be secured if the breech block 3 is positioned toward the front of the handle piece 1 and the rear portion 23 is lowered because the finger 105 is positioned outside of the active area of the securing device 40 when the slide 101 is in the first position 112.

FIGS. 2-7 depict another example trigger device, mechanism or apparatus 200 that includes a pivot lever or securing element (e.g., a two-armed pivot lever) 201 instead of the slide 101. The pivot lever 201 is positioned around and/or pivotal about a pivot axis 202. The pivot axis 202 may be positioned transverse to the axis of the bore 5 and adjacent to a rear portion of the catch 21. The pivot lever 201 includes a first or upper portion or first actuating element (e.g., an upper or first lever arm) 203 having a rear abutting surface or surface 207. The surface 207 is engageable by the sear catch 33 of the breech block 3. When the surface 207 of the upper portion 203 is engaged by the sear catch 33, the breech block 3 moves the pivot lever 201 against a biasing force of a spring arrangement or assembly 204 to a securing position. In the securing position, a first or lower portion or securing part (e.g., a lower lever arm) 205 of the pivot lever 201 is positioned in an active area of the securing device 40 (illustrated in connection with FIGS. 2 and 3). When the pivot lever 201 is moved by the breech block 3 toward the catch 21, the upper portion 203 is positioned completely and/or substantially within or adjacent to a profile of the sear arm 31.

If the sear catch 33 does not engage the sear arm 31, the pivot lever 201 is urged by the spring arrangement 204 to be positioned in a first position (e.g., an idle position). In the first position, the lower portion 205 is outside of and/or at a distance from the active area of the securing device 40 and the upper portion 203 protrudes to and/or extends from a first or rear end 402 (FIG. 4) of a profile of the sear arm 31 (illustrated in connection with FIGS. 4-7).

The functionality of the securing device 40 included in the trigger apparatus 200 of FIGS. 2-7 is similar to that of the securing device 40 included in the trigger apparatus 100 of FIG. 1. However, relatively short travel distances may be achieved with the upper portion 203 by having the lower portion 205 relatively longer and/or a different size than the upper portion 203, for example. By having the lower portion 205 relatively longer than the upper portion 203, a relatively small movement and/or short pivoting path of the upper portion 203 may in turn produce a relatively large movement and/or long pivoting path of the lower portion 205.

The travel distance of the upper portion 203 may be so short that an overlap with the sear catch 33 of the retracting breech block 3 may only extend minimally toward the rear of the weapon (e.g., similar size as the catch 1314 without the catch 21). As such, at least the trigger apparatus 200 and/or the breech block 3 arrangement illustrated in FIGS. 2-7 may be exchangeable with the known breech block arrangement of FIGS. 13-14 without additional adaptations. To exchange the known breech arrangement of FIGS. 13-14 included in an existing weapon with the examples illustrated in FIGS. 2-7, the handle piece may be the only piece exchanged.

Figure 7:
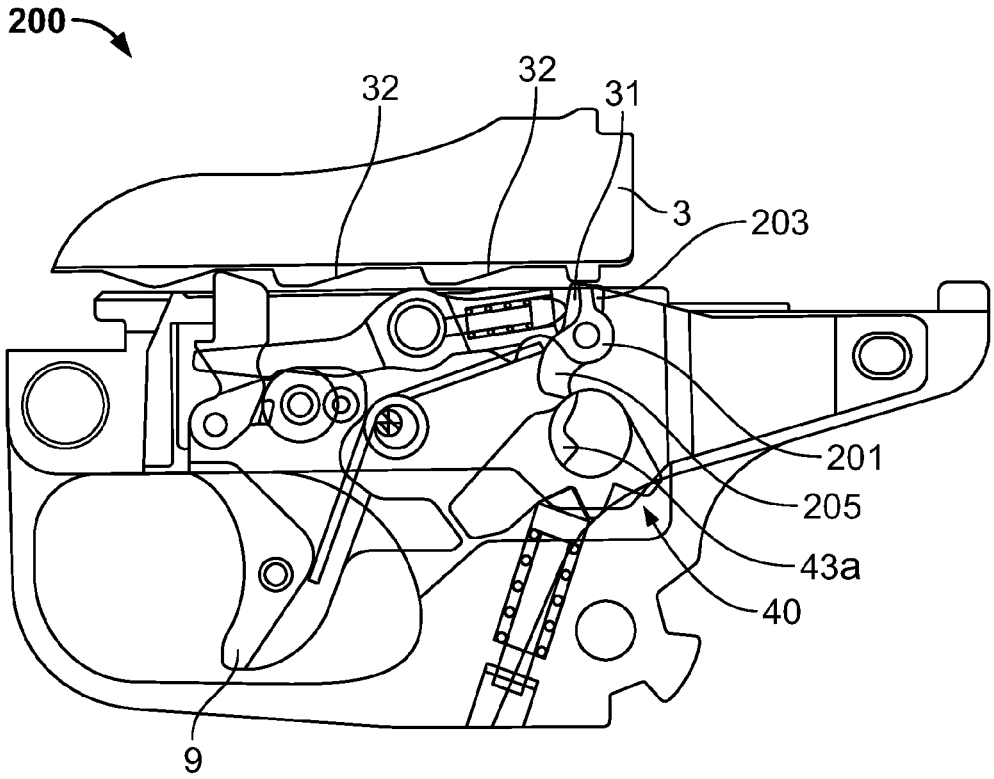
Figure 8:
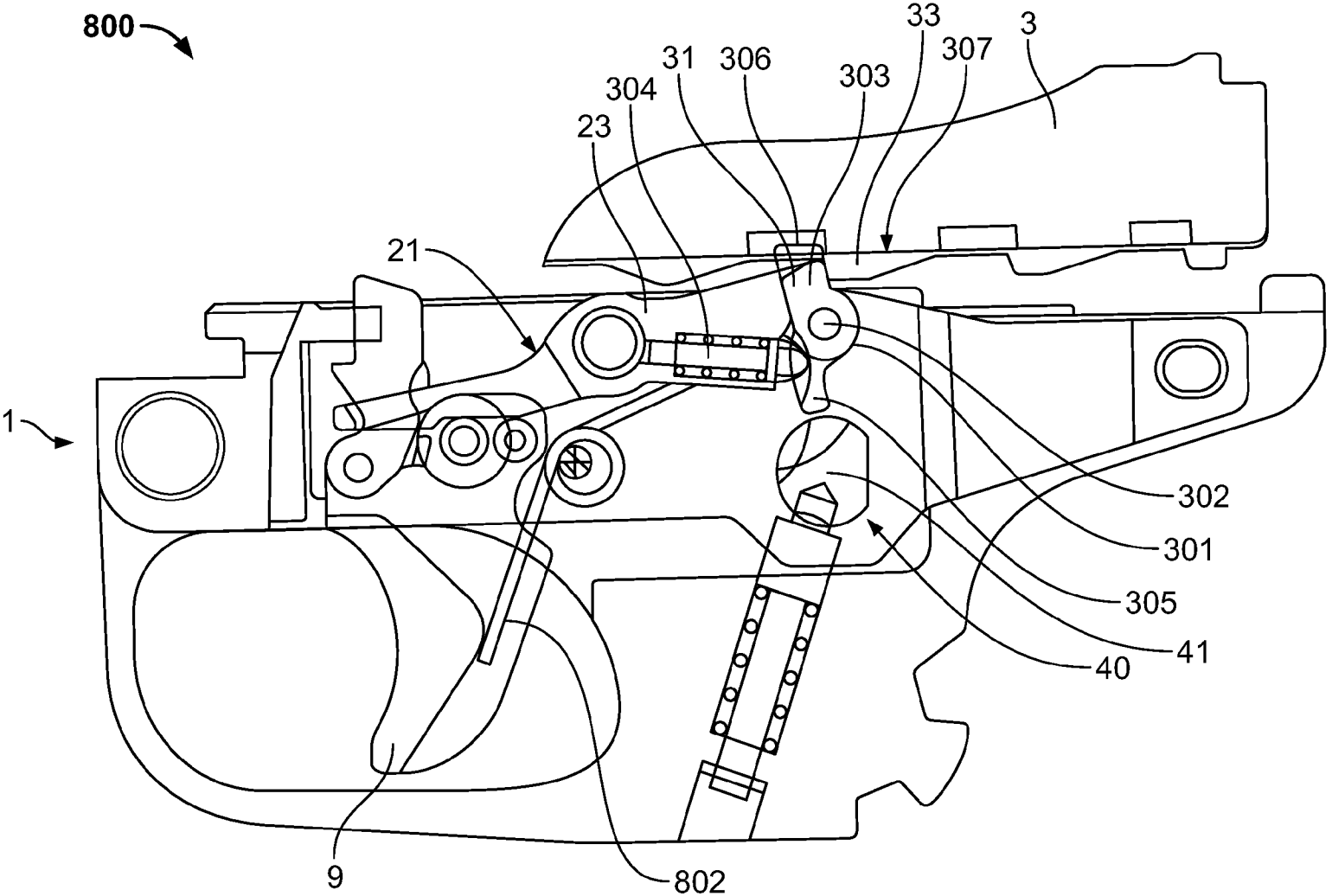
FIGS. 8-9 depict different positions of example components of another example trigger apparatus.
Figure 9:
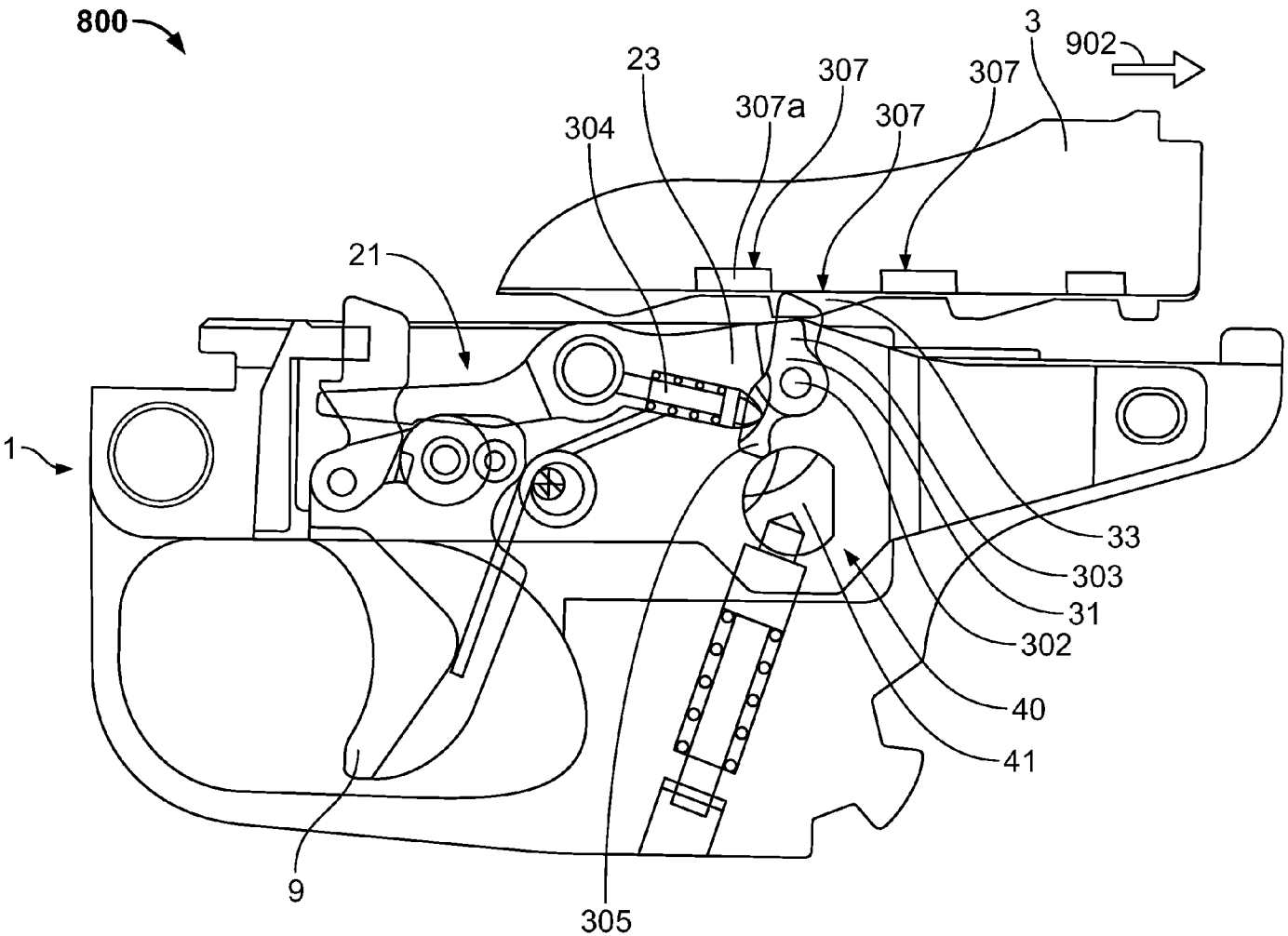

FIGS. 8 and 9 depict an example trigger device, mechanism or apparatus 800. The trigger apparatus 800 is similar to the trigger apparatus 200 described in connection with FIGS. 2-7. However, the trigger apparatus 800 includes a pivot lever or securing element 301 having a first or lower portion or securing part (e.g., a lower lever arm) 305 that is biased and/or engaged by a spring arrangement or assembly 304. The spring arrangement 304 may engage the lower portion 305 adjacent the rear portion 23 of the catch 21. The spring arrangement 304 may press and/or bias the pivot lever 301 counterclockwise toward a securing position. By biasing the pivot lever 301 toward the securing position, when the securing device 40 is positioned in the securing position, the catch 21 is to be positioned in the securing position regardless of the position of the breech block 3 (illustrated in connection with FIGS. 8 and 9).

To substantially ensure that the movement of the breech block 3 is not hindered by the catch 21 being fixed in the blocking position, a second actuating element 306 is provided. The second actuating element 306 is positioned on and/or pivotably coupled to a pivot axis 302 of the pivot lever 301. The second actuating element 306 may be configured as a control cam and may be arranged with a first actuating element or lever arm 303. The first and second actuating elements 303 and 306 may be jointly pivotable around and/or about the pivot axis 302. For example, the pivot lever 301 may be diverted by the second actuating element 306. If the second actuating element 306 diverts the pivot lever 301 clockwise, the lower portion 305 disengages and/or moves to be at a distance to the securing device 40. With the lower portion 305 disengaged from the securing device 40, the rear portion 23 and/or the sear arm 31 may be lowered. The breech block 3 may define and/or include a control profile 307. The control profile 307 includes a profile similar to the sear catch 33 on the underside of the breech block 3 (e.g., the control profile includes a contour adapted to the course of the sear catch profile). FIG. 9 depicts the breech block 3 retracting in the direction of arrow 902 and engaging, via the control profile 307, the second actuating element (e.g., the control cam) 306. The engagement between the control profile 307 and the second actuating element 306 moves (e.g., deflects) the pivot lever 301 clockwise against a biasing force of the spring arrangement 204 to position the pivot lever 301 in a first or release position. As with the first position 112 described above, in the release position, the lower portion 305 of the pivot lever 301 does not engage and/or is positioned at a distance from the securing device 40. With the lower portion 305 not interacting with the securing device 40, the sear catch 33 can then press the rear portion 23 downward enabling the breech to move toward the rear position.

The breech block 3 moves toward the rear of the weapon until the second actuating element (e.g., the control cam) 306 is positioned within and/or adjacent to a recess 307*a* of the control profile 307, for example. The catch 21 then is pressed upward (e.g., simultaneously) with the rear portion 23 biased by a spring 802 (e.g., the spring 13). The sear arm 31 falls in before and/or is positioned adjacent to the sear catch 33 to block and/or substantially prevent further advancement of the breech block 3. The pivot lever 301 returns to and/or resumes the securing position and the catch 21 is positioned in the blocking position as long as the securing device 40 is in the securing position. In addition to the spring arrangement 304, a front end of the sear catch 33 urges and/or presses the pivot lever 301 into the profile of the sear arm 31 (compare to the examples illustrated in connection with FIGS. 2-7).

The second actuating element 306 of the control cam enables the pivot lever 301 to be reliably controlled without the spring arrangement 304 and/or after a malfunction (e.g., if a spring breaks) to substantially ensure the securing function for the weapon (illustrated in connection with FIGS. 8 and 9). For example, the pivot lever 301 is reliably moved and/or brought to the release position by the control profile 307 when the breech block 3 retracts (as illustrated in connection with FIG. 9) and/or by one of the sear catches 33 that engages the first actuating element 303 (upper portion) when the breech block 3 advances, thereby moving and/or bringing the securing element 301 (pivot lever) to the securing position.

In the examples described in connection with FIGS. 8 and 9, the securing device 40 is configured as a rotatable safety roller 41 having corresponding recesses 43. However, in other examples, the securing device 40 may be configured as a slide safety. In such examples, a corresponding securing profile may be configured either relative to the axis of the bore 5 and/or parallel to the axis of the bore 5. Additionally or alternatively, the securing device 40 includes a corresponding securing profile having recesses and active areas that, as described in connection with the safety roller 41, interact with the securing element of the catch 21 (e.g., the slide 101 or the pivot lever 201). Additionally or alternatively, the securing device 40 may be directly coupled to a corresponding actuator that may control a weapon(s) of a weapons station, for example. In other examples, the trigger 9 may be provided with separate interfaces where the one or more actuators may be arranged and/or positioned.

Figure 10:
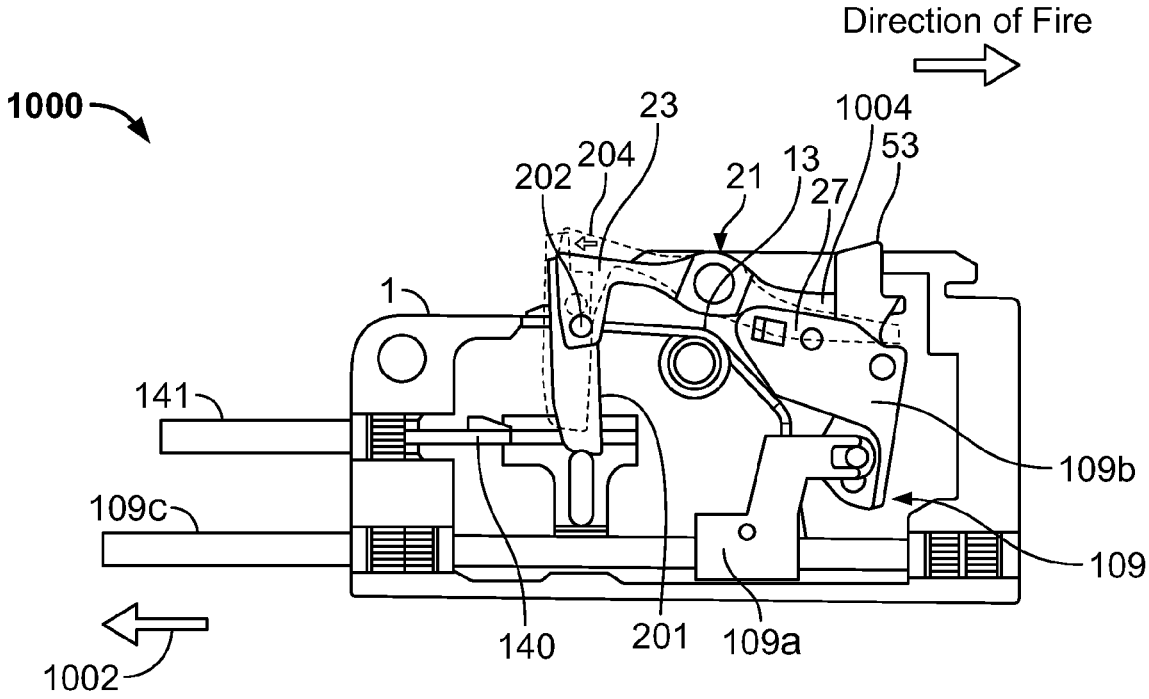
FIGS. 10-12 depict different views and different positions of example components of another example trigger apparatus.
Figure 11:
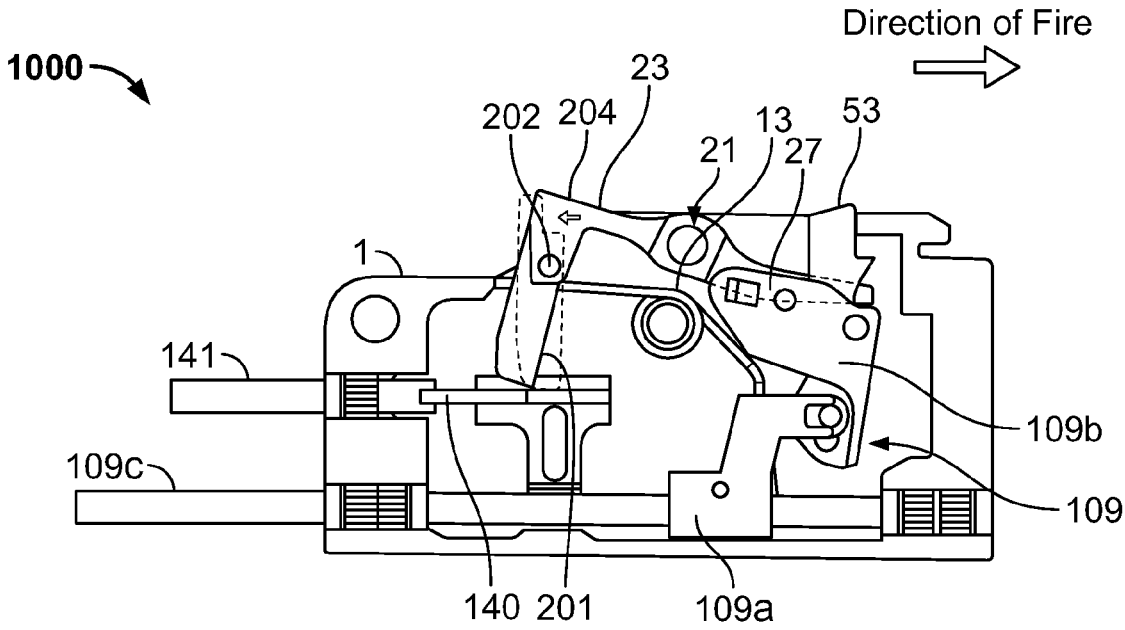
Figure 12:
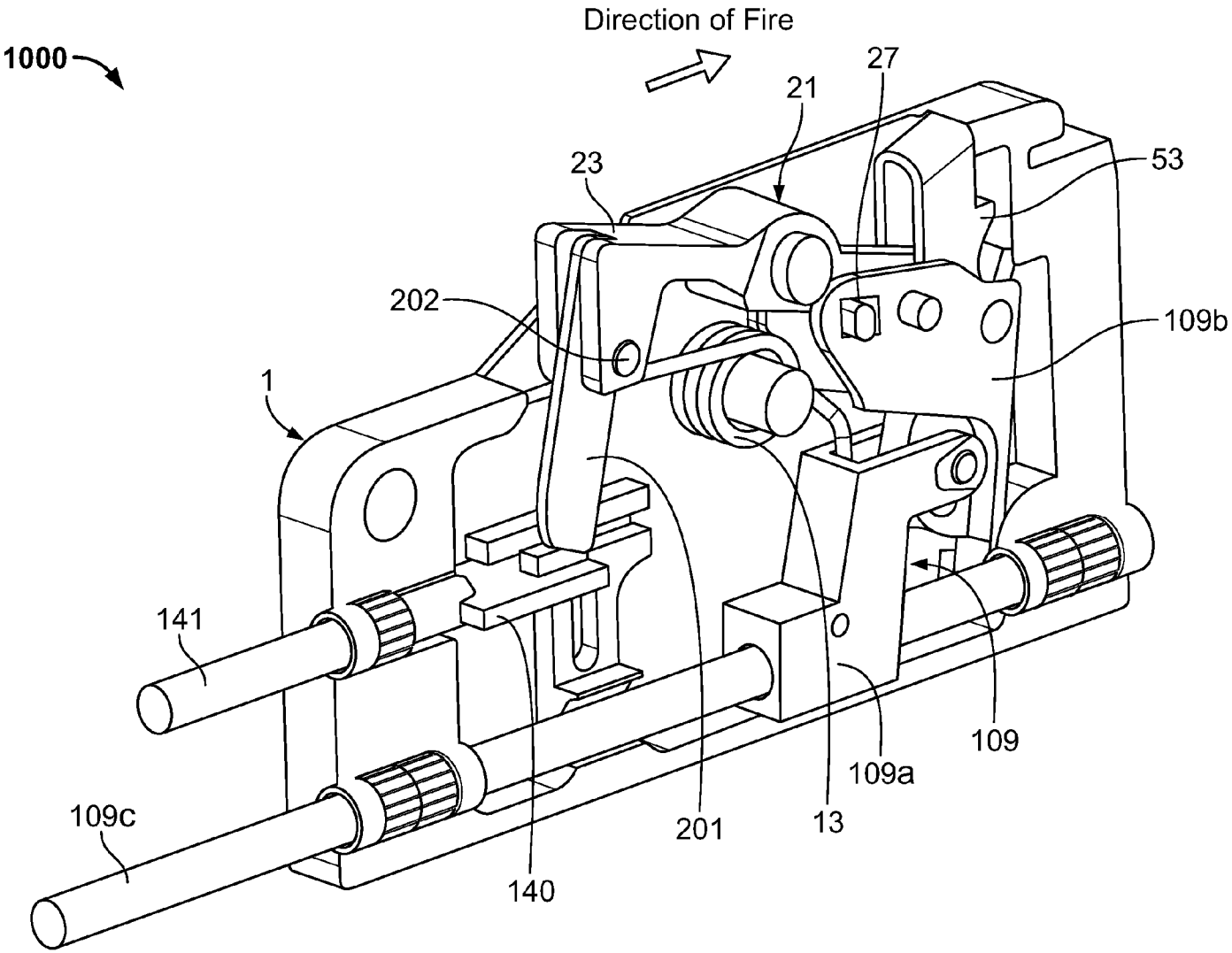

FIGS. 10-12 depict an example trigger device, mechanism or apparatus 1000 including the handle piece 1 and the example catch 21, for example. The example trigger apparatus 1000 may be used in a machine handle piece that may be utilized in connection with (e.g., inserted into) a weapon used with a weapons station. The trigger apparatus 1000 includes a trigger 109 having a bracket 109*a* fixed and/or coupled to an actuating or trigger bar or interface 109*c*. A trigger element 109*b* may be hinged and/or rotatably coupled to the bracket 109*a*. The catch 21 and the pivot lever 201 are similar to the catch 21 and the pivot lever 201 described in connection with FIGS. 2-7; however, the catch 21 and the pivot lever 201 described in connection with FIGS. 10-12 may have a different geometry (e.g., a slightly different geometry). Additionally or alternatively, instead of the securing device 40 described above, a securing slide, bar or device 140 is provided that may be actuated by a securing bar or interface 141. FIG. 10 depicts the handle piece 1 and the securing device 10 positioned in the firing position (e.g., the safety of the weapon is off). When the securing device 10 is positioned in the firing position and the actuating bar 109*c* is moved in a direction generally represented by arrow 1002, the actuating bar 109*c* moves and/or pulls the trigger element 109*b*, via the bracket 109*a*, and raises the catch 21 over the release roller 27 on a front end 1004 of the catch 21. Raising the front end 1004 of the catch 21 in turn lowers the rear end of the catch 21 and releases the breech block 3.

As illustrated in FIGS. 11 and 12, the securing slide 140 is positioned in the securing position and shelters and/or secures the position of the pivot lever 201 and/or the lower portion 205 when the breech block 3 engages the rear portion 23 of the catch 21 and moves the pivot lever 201 to the position illustrated in FIG. 11. With the securing slide 140 in the securing position and the breech block 3 engaging the rear end of the catch 21, it is not possible to fire the weapon (e.g., safety position). If the breech block 3 does not engage the rear end of the catch 21, the spring arrangement 204 moves the pivot lever 201 to the position illustrated in FIG. 11 in semi-dashed lines. In this position, the lower portion 205 of the pivot lever 201 may move downward past the securing slide 140 into the handle piece 1 even if the securing slide 140 is in the securing position. Thus, because the pivot lever 201 may be depressed within the handle piece 1, the breech block 3 may be retracted toward the rear position unhindered. In some examples, the securing bar 141 and/or the actuating bar 109*c* may be coupled to one or more actuators (not shown) that actuate the securing bar 141 and/or the actuating bar 109*c*.

As depicted in FIGS. 11, and 12, the actuators, the securing bar 141 and/or the actuating bar 109*c* may be controlled such that the actuating bar 109*c* is moved to the non-firing position (e.g., opposite the direction generally indicated by arrow 1002) and the securing slide 140 is moved to the securing position if a malfunction (e.g., a power failure, a cable break, etc.) occurs, for example. The securing slide 140 may be coupled to the securing bar 141. Because of the example catch 21, the securing slide 140 may be moved to the securing position and the actuating bar 109*c* may be moved to the non-firing position regardless of the position and/or movement of the breech block 3. In some examples, the trigger apparatus 1000 may be provided with one or more sensors that may identify a malfunction and/or position of the actuating bar 109*c* and/or the securing slide 140. The information sensed by the one or more sensors may be conveyed via signals to a control system for further processing, for example.

The examples described herein relate to the example catch 21 for use with the trigger apparatus 100, 200, 800 and/or 1000 of a weapon having the securing device 40 and/or 140. The catch 21 is moveable between a first position blocking the breech block 3 path and a second position not blocking and/or at a distance from the breech block 3 path. The catch 21 includes the securing element 101, 201 and/or 301 that is moveable relative to the catch 21 between a first or releasing position (e.g., the first position 112) and a second or securing position (e.g., the second position 114).

As the breech block 3 retracts and engages the catch 21 with the lower surface of the breech block 3, the securing element 101, 201 and/or 301 is positioned in the releasing position. The breech block 3 actuates the securing element 101, 201 and/or 301 (e.g., in a rearward direction) into the hand piece 1 even if the securing device 40 and/or 140 is in the securing position and, thus, enables the catch 21 to be moved to the non-blocking position. Generally, the breech block 3 may moved to the rear position during recoil or cocking and the cylinder (e.g., the safety roller 41) may be moved regardless of the lowering of the catch 21.

The securing element 101, 201 and/or 301 is positioned in the securing position when the breech block 3 engages the securing element 101, 201 and/or 301 and moves and/or actuates the securing element 101, 201 and/or 301 forward (e.g., from the first position 112 to the second position 114). When both the securing element 101, 201 and/or 301 and the securing device 40 and/or 140 are positioned in the securing position, the securing element 101, 201 and/or 301 engages and/or interacts with the securing device 40 and/or 140 fixing and/or securing the catch 21 in the blocking position.

The catch 21 may secure the breech block 3 in the rear position and the catch 21 may be secured in the blocking position independent of one another and, thus, the examples described herein may be optimally configured for particular designs.

The catch 21 may be relatively robust and stable to enable the catch 21 to be exposed to relatively high stresses (e.g., mechanical stresses) that may occur via the interaction with the breech block 3. The securing element 101, 201 and/or 301 may not be exposed to relatively high stresses from the breech block 3 and, thus, may be designed to substantially ensure a reliable interaction with the securing device 40 and/or 140.

The arrangement of the securing element 101, 201 and/or 301 relative to the securing device 40 and/or 140, for example, substantially prevents components of the securing element 101, 201 and/or 301 from colliding with one another regardless of the state of the weapon.

Additionally, the risk of a weapon continuing to fire when the trigger is not actuated as compared to known approaches is significantly reduced by the ability of the sear arm 31 to engage the sear catch 33 if a malfunction occurs with the securing element 101, 201 and/or 301.

The examples described herein enable a weapon having the catch 21 to be cocked and have the cylinder rotated in the secured stated. Additionally or alternatively, the securing device 40 and/or 140 may be actuated when the weapon is in any state.

To increase functional reliability, the securing element 101, 201 and/or 301 may be moved against a spring force from the releasing position (e.g., the first position 112) to the securing position (e.g., the second position 114), for example. The spring arrangement (e.g., the spring arrangement 104) urges the securing element 101, 201 and/or 301 to be positioned in the releasing position when the breech block 3 does not act against the securing element 101, 201 and/or 301 (e.g., when the breech block 3 is retracting). However, the spring arrangement (e.g., the spring arrangement 104) enables the securing element 101, 201 and/or 301 to be positioned in the securing position via the interaction with the forward acting breech block 3. The examples described herein substantially prevent undefined intermediate positions of the securing element 101, 201 and/or 301 that may impair the functionality of the weapon, for example.

The spring arrangement (e.g., the spring arrangement 104) enables the securing element 101, 201 and/or 301 to be positioned in the securing position when the breech block 3 abuts and/or engages the catch 21 but otherwise enables the securing element 101, 201 and/or 301 to be extended (e.g., the first position 112). Therefore, the catch 21 may be freely moveable in all positions of the breech block 3 substantially minimizing the possibility of malfunctions (e.g., the breech block 3 jamming on the catch 21). When the securing device 40 and/or 140 is positioned in the securing position, the catch 21 may be lowered via the breech block 3 when the securing element 101, 201 and/or 301 is moved by the breech block 3 from the securing position to the releasing position.

The securing element 101, 201 and/or 301 may include the first actuating element 103, 201 and/or 303 that interacts with the breech block 3. The breech block 3 may move the securing element 101, 201 and/or 301 to the securing position. When the securing element 101, 201 and/or 301 is positioned in the securing position, the securing part 105, 205 and/or 305 may be positioned adjacent to and/or engage the active area of the securing device 40 and/or 140.

The securing element 101, 201 and/or 301 may be positioned adjacent to the sear arm 31 of the catch 21 when the breech block 3 engages the catch 2 and the catch 21 is in the blocking position. The sear arm 31 may reliably and stably engage the breech block 3. The securing element 101, 201 and/or 301 being adjacent the breech block 3 and engaging the sear arm 31 and/or the catch 21 moves the securing element 101, 201 and/or 301 to the securing position.

The first actuating element 103, 203 and/or 303 may be substantially within the profile of the sear arm 31 when the breech block 3 is positioned in the rear position. Positioning the first actuating element 103, 203 and/or 303 within the profile of the sear arm 31 reduces the stress imparted on the first actuating element 103, 203 and/or 303 and, thus, the securing element 101, 201 and/or 301. The breech block 3 is secured, blocked and/or locked in the rear position via the interaction between the sear arm 31 and the breech block 3. The securing element 101, 201 and/or 301 may not experience any additional loads (e.g., mechanical load) via the breech block spring through the breech block 3, the catch 21 and/or the sear arm 31.

The securing element 301 may include the second actuating element 306. The second actuating element 306 may be moveable (e.g., drivable) by the retreating breech block 3 to enable the securing element 301 to be positioned in the releasing position and the securing part 305 to be outside of the active area of the securing device 40 and/or 140 even if the securing device 40 and/or 140 is in the securing position. The first actuating element 303 and the second actuating element 306 may be separated and/or perform different functions, for example. A relatively large amount of force may be needed to depress the catch 21 but a relatively small amount of force may be needed to deflect the securing element 301 to the release position. The securing element 301 may be actuated with a relatively small force and/or load and relatively precisely by the securing element 301.

The second actuating element 306 may be configured as a control cam that protrudes and/or extends into the breech block 3 path. If the breech block 3 retracts, the second actuating element 306 may be moved by and/or interact with the control profile 307 of the breech block 3. The control cam of the second actuating element 306 and the control profile 307 may be configured and/or coordinated to ensure the interaction (e.g., locking) between the breech block 3 and the catch 21 is substantially uninfluenced. Additionally or alternatively, a corresponding profile may be defined by (e.g., by milling) the breech block 3 or portions of the breech block 3.

The securing element 101 may be configured as a slide that is moveable and/or actuatable in a barrel direction. Configuring the securing element 101 as a slide enables the securing element 101 to be reliably shielded via an interaction with the catch 21 and may reduce and/or minimize stress(es) induced by the breech block 3.

The securing element 201 and/or 301 may be configured as a pivot lever that is pivotable about the pivot axis 202 and/or 302. The pivot axis 202 and/or 302 may be positioned and/or runs transversely to the movement of the breech block 3, for example. The transverse position of the pivot axis 202 and/or 302 relative to the breech block 3 enables the actuation direction of the securing element (e.g., the pivot lever) to correspond to the direction of movement of the breech block 3.

The pivot lever 201 and/or 301 may be configured with two portions and/or arms (e.g., the upper and lower portions 203 and 205). The upper portion 203 includes an actuating element and the lower portion 205 includes the securing part. The portions 203 and 205 may enable the actuation direction of the lower portion 205 to be redirected by the breech block 3. The portions 203 and/or 205 may form an angle relative to one another, which may enable some characteristics (e.g., specific constructive marginal conditions) to be relatively flexible.

The upper portion 203 and/or 303 may be shorter than and/or a different length than the lower portion 205 and/or 305. The different lengths enable the travel distance (e.g., the distance traveled by the upper portion 203 and/or 303) and the safety distance (e.g., the distance traveled by the lower portion 205 and/or 305) to be different. For example, a length ratio of the upper portion 203 and/or 303 and the lower portion 205 and/or 305 may be between about 1:2 or 1:3. Having the lower portion 205 and/or 305 relatively long enables the lower portion 205 and/or 305 to be at a distance from the active area of the securing device 40 and/or 140 and/or to interact with the securing device 40 and/or 140. Thus, the securing part may have a relatively large area and/or be stable with regard to the required active areas and mechanical stresses.

The pivot axis may be the focal point of the pivot lever enabling the pivot lever to be dynamically balanced (e.g., the pivot lever may not be moved from the securing position by lateral forces and/or accelerations acting on the weapon).

The self locking design of the active areas on the securing part or the corresponding surface of the securing device 40 and/or 140 may further increase the securing action. For example, the active area of the securing part and the counter surface of the securing device 40 and/or 140 may be prevented from sliding from and/or moving relative to one another and disturbing the security function even if the sear arm 31 is exposed to a high load. A high load to the sear arm 31 may occur via high dynamic stresses to the weapon and/or if the trigger is actuated by a motor and, thus, acts with high forces against the securing action, for example.

The trigger apparatus 1000 or any of the other examples described herein may include at least one interface 109*c* and/or 141 that may be coupled (e.g., directly or indirectly) to the trigger 9 and/or 109 and/or the securing device 40 and/or 140 to enable actuation thereof. Use of such actuators may be advantageously utilized in weapons of weapons stations. The example trigger apparatus 100, 200, 300 and/or 1000 and its corresponding handle piece 1 may be exchanged with a conventional handle piece without significant if any modification.

FIG. 1 depicts a partial cutaway view of a handle piece and an example trigger device in which the securing element is configured as a slide.

Figure 2:
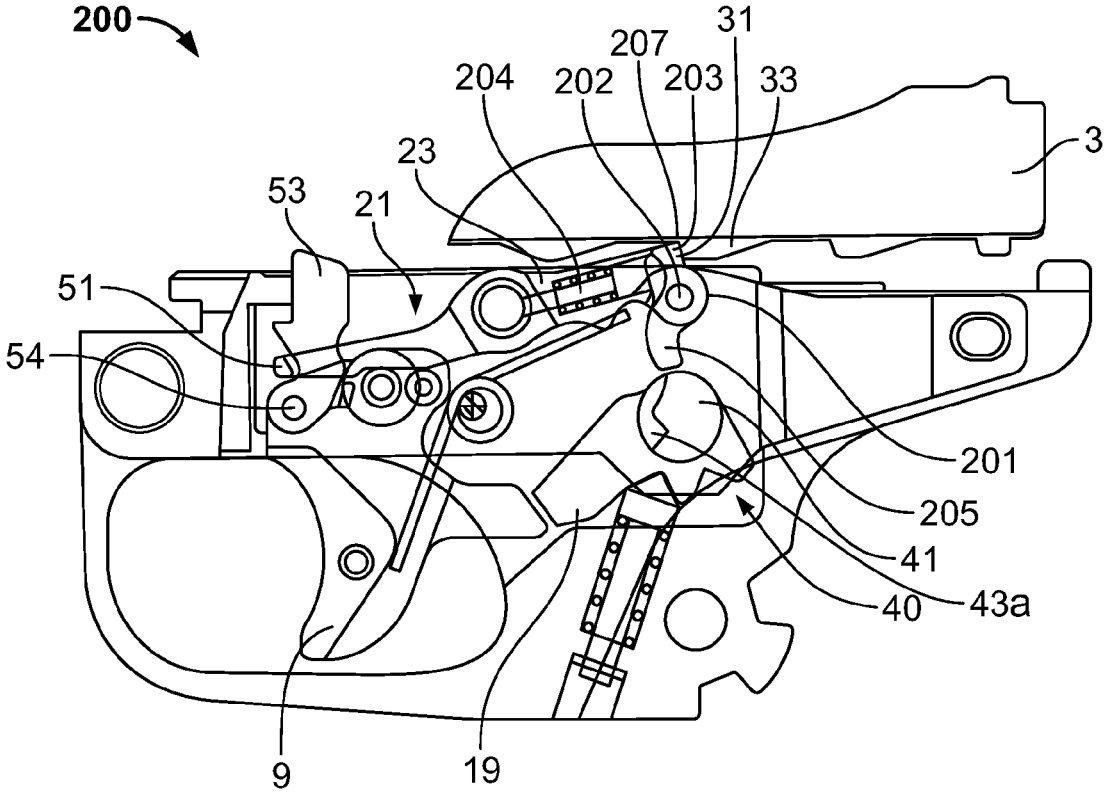
FIGS. 2-7 depict different positions of example components of another example trigger apparatus.
Figure 3:
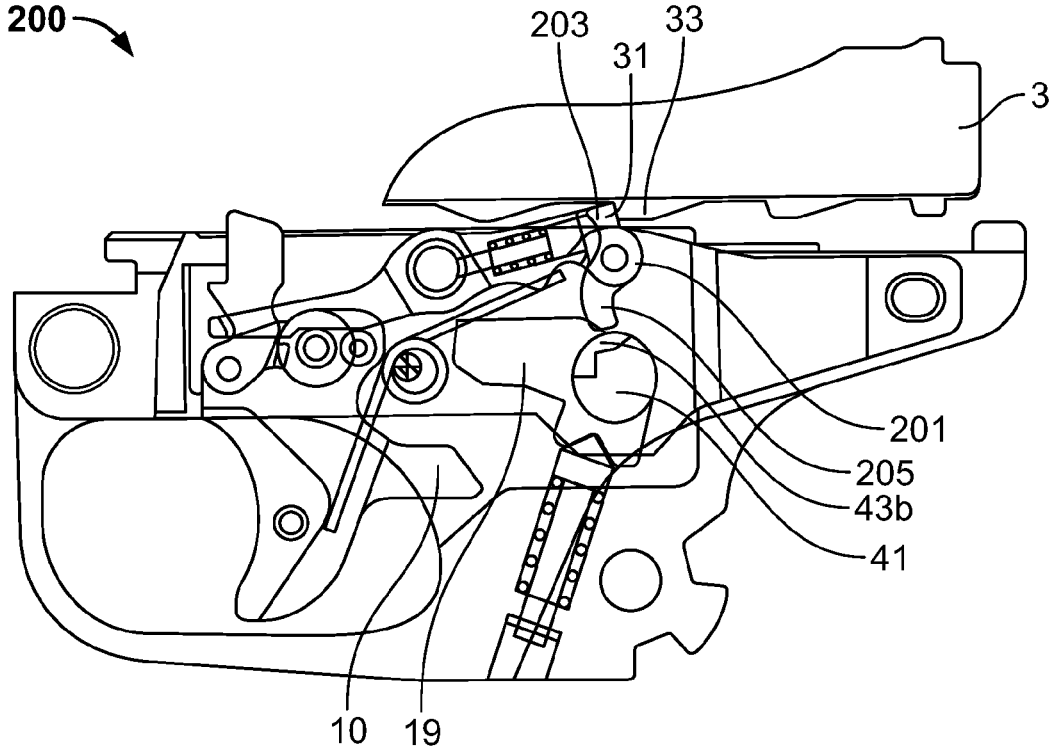
Figure 4:
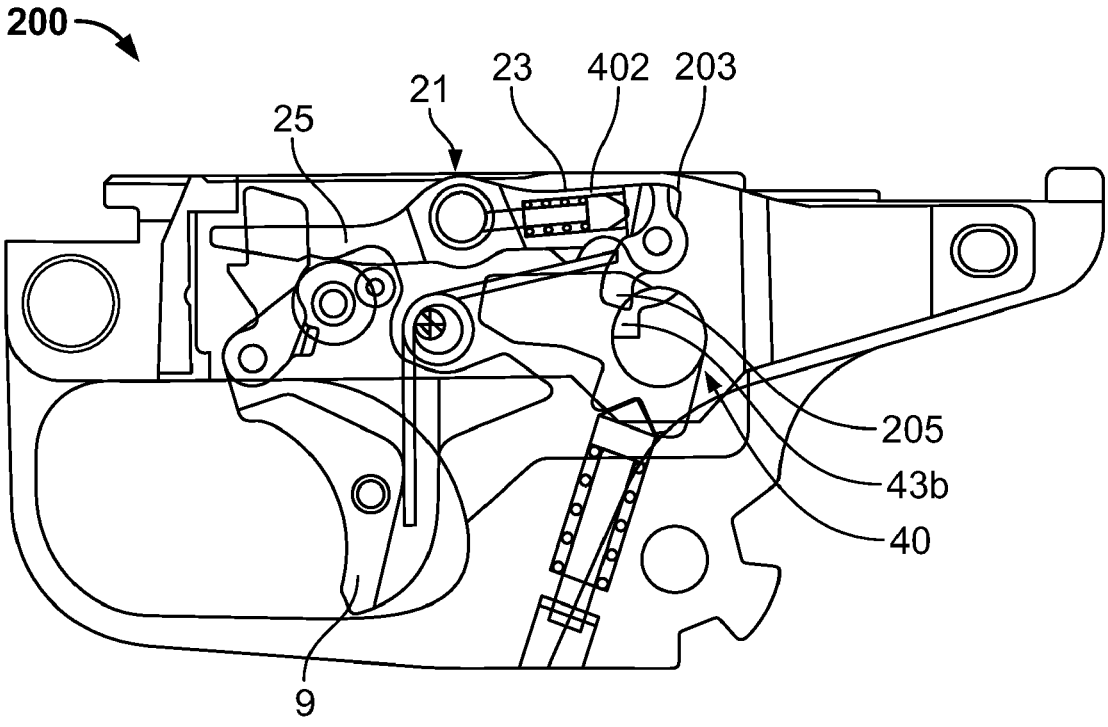
Figure 6:
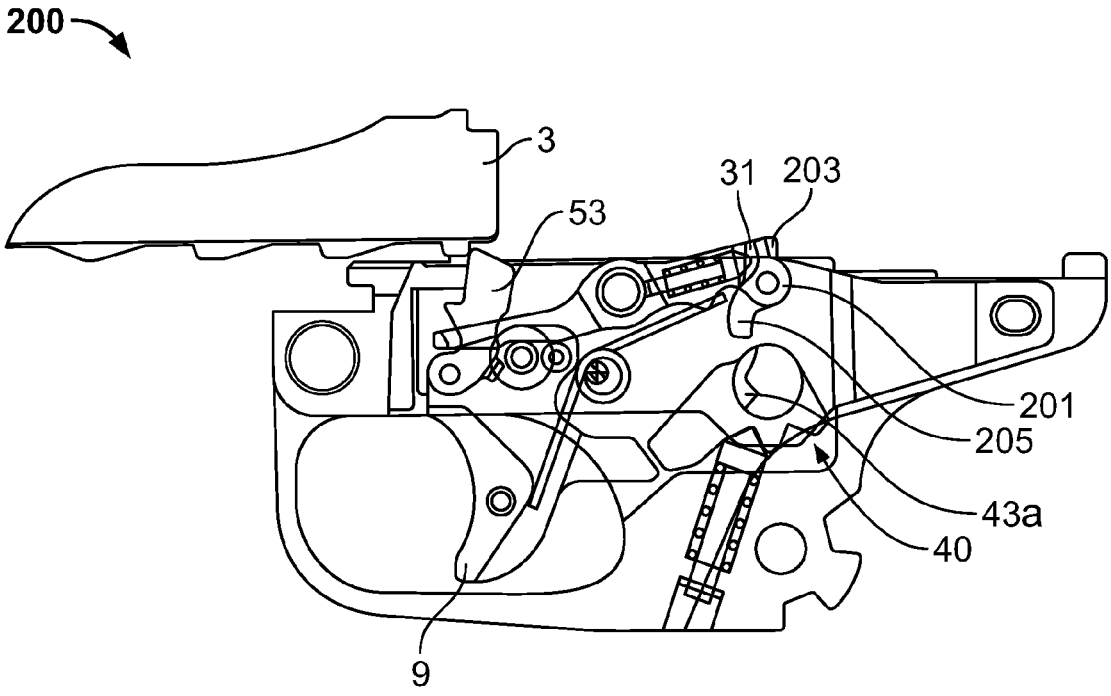

FIG. 2 depicts a lateral view of a handle piece of another example trigger device in which the securing element is configured as a pivot lever. In FIG. 2, the catch is positioned in the blocking position retaining the breech block and the securing device is positioned in the safe position. FIG. 3 depicts the example trigger device of FIG. 2 in which the securing device is positioned in the fire position. FIG. 4 depicts the example trigger device of FIG. 2 in which the breech block is released, the trigger is actuated and the securing device is in the fire position. FIG. 5 depicts the trigger device of FIG. 4 in which the trigger has been released, the release catch is locked into position with the catch and the safety device is in the safe position. FIG. 6 depicts the example trigger device of FIG. 5 in which the retracting breech block has moved the catch to the blocking position by the actuation of the release catch. FIG. 7 depicts the example trigger device of FIG. 6 in which the retracting breech block has deflected the catch engaged on the sear arm from the blocking position and the securing device is positioned in the safe position.

FIG. 8 depicts a partial cutaway view of a handle piece, an example catch and example trigger device. In FIG. 8, the securing element is configured as a pivot lever and, is positioned in the blocking position retaining the breech in the rear position. The securing device is positioned in the securing position. FIG. 9 depicts a lateral view of the example trigger device of FIG. 8 in which the catch is positioned in the non-blocking position and the breech is retracting toward the rear of the weapon. The securing device is positioned in the securing position.

FIG. 10 depicts an example trigger device in which the security function and the trigger function may be actuated via remote actuated guide bars (e.g., via actuators controllable via remote control). The securing device is positioned in the firing position. FIG. 11 depicts the example trigger device of FIG. 10 in which the securing device is in the safe position. FIG. 12 depicts a perspective view of the example trigger device of FIG. 10.

Figure 13:
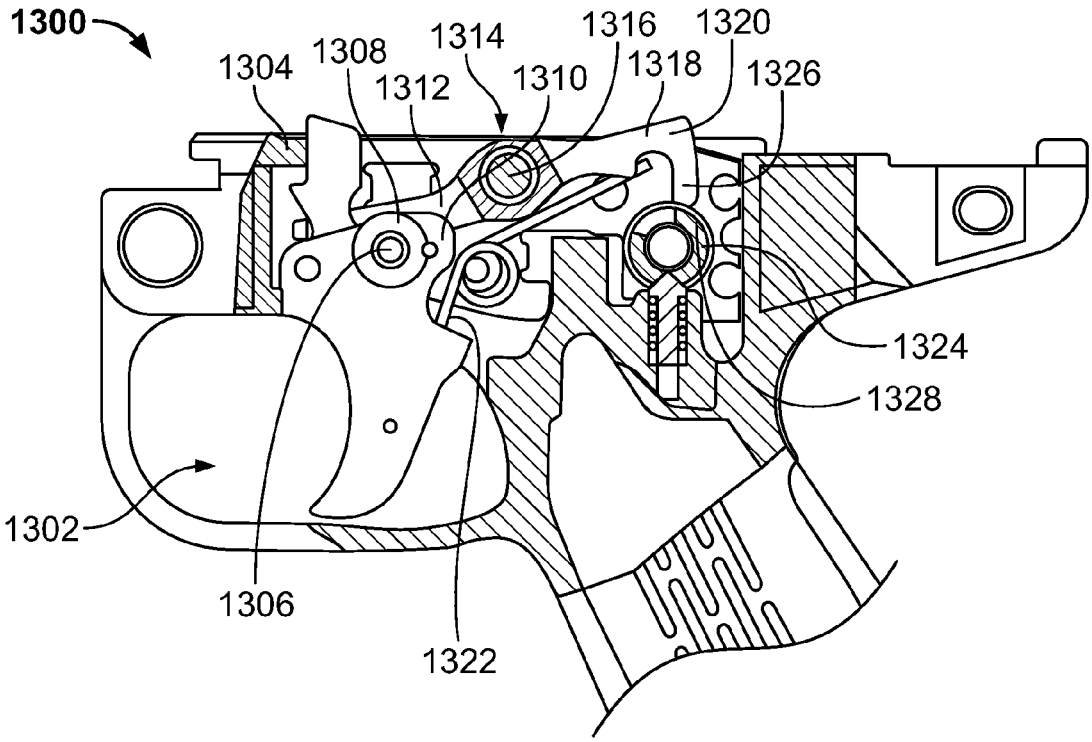
FIG. 13 (Prior Art)
FIGS. 13-14 depict a known trigger mechanism.
Figure 14:
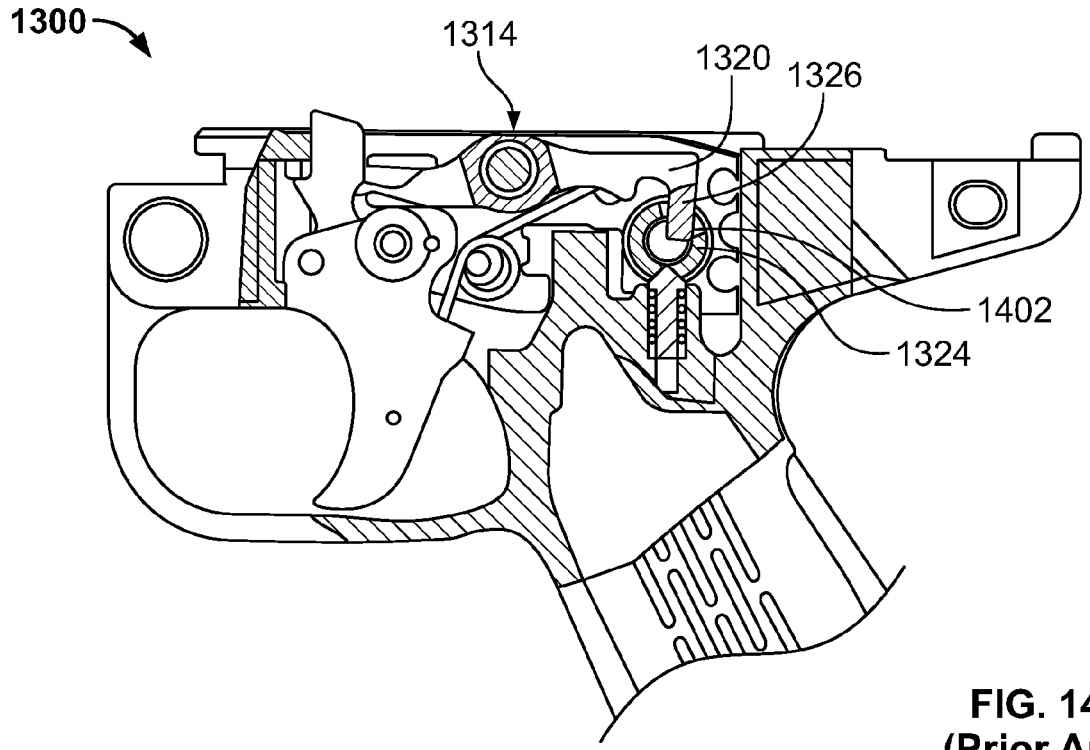
FIG. 14 (Prior Art)

FIG. 13 depicts a known trigger mechanism having a safety roller that is positioned in the safe position. FIG. 14 depicts the known trigger mechanism of FIG. 13 in which a nose of the catch is jammed by a safety roller.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A catch for a trigger apparatus of a firearm having a breech and a securing device, wherein the catch is moveable between a blocking position that blocks the breech and a non-blocking position that does not block the breech, the catch comprising:

a securing element moveable relative to the catch between a releasing position and a securing position, wherein the securing element is positioned in the releasing position when the breech block retracts relative to the catch even if the securing device is in a securing position enabling the catch to be moved to the non-blocking position;

wherein the securing element is positioned in the securing position when the breech block advances toward the catch and actuates the securing element forward, in the securing position, the securing element engages the securing device when the securing device is in the securing position to substantially fix the catch in the blocking position wherein the securing element is moveable from the releasing position to the securing position against a spring force.

2. The catch as defined in claim 1, wherein the securing element is moveable from the securing position to the releasing position by a spring force.

3. The catch as defined in claim 1, wherein the securing element comprises a first actuating element and a securing part, wherein the first actuating element is engageable by an advancing breech block to enable the securing element to be moved to the securing position and to enable the securing part to be positioned adjacent to an active area of the securing device in the securing position.

4. The catch as defined in claim 1, wherein the securing element is to be positioned adjacent to a sear arm of the catch when the catch is positioned in the blocking position and engaged by the breech block.

5. The catch as defined in claim 1, wherein the securing element further comprises a first actuating element that is positioned substantially within a profile of a sear arm of the catch when the catch is positioned in the blocking position and engaged by the breech block.

6. The catch as defined in claim 1, wherein the securing element further comprises a second actuating element and a securing part, wherein the second actuating element is engageable by a retracting breech block to enable the securing element to be moved to the releasing position and the securing part to be positioned outside of an active area of the securing device in the securing position.

7. The catch as defined in claim 6, wherein the second actuating element comprises a control cam that protrudes at least partially into a breech block path, wherein the second actuating element is engageable by a control profile of a retracting breech block.

8. The catch as defined in claim 1, wherein the securing element comprises a slide that is moveable relative to a barrel of the firearm.

9. The catch as defined in claim 1, wherein the securing element comprises a pivot lever that is pivotable relative to the catch about a pivot axis.

10. The catch as defined in claim 9, wherein the pivot axis is transverse to a direction of movement of the breech block.

11. The catch as defined in claim 9, wherein the pivot lever comprises a first lever arm and a second lever arm, the first lever arm comprises an actuating element and the second lever arm comprises a securing part.

12. The catch as defined in claim 11, wherein the first lever arm comprises a first length and the second lever arm comprises a second length different than the first length.

13. The catch as defined in claim 11, wherein a ratio of the first lever arm relative to the second lever arm is at least one of a 1:2 ratio or a 1:3 ratio.

14. The catch as defined in claim 1, further comprises a trigger apparatus comprising the catch.

15. The catch as defined in claim 14, further comprising one or more interfaces to enable at least one of a trigger of the trigger apparatus or the securing device to be coupled to one or more actuators.

16. A trigger apparatus for use with a firearm having a breech, comprising:

a latch moveable between a blocking position that blocks the breech and a non-blocking position that does not block the breech, wherein the latch comprises:

a sear arm;

a spring assembly; and a securing element moveable between a first position and a second position, wherein the spring assembly is to bias the securing element, wherein in the first position, the securing element is positioned at a distance from the sear arm and a surface of a securing device in a securing position to enable the latch to be moved to the non-blocking position and the breech to retract relative to the weapon, wherein in the second position, the securing element is positioned adjacent the sear arm via the breech and the surface of the securing device in the securing position to secure the latch in the blocking position wherein the securing element is moveable form the first position to the second position against a spring force of the spring assembly via the breech block.

17. The trigger apparatus as defined in claim 16, wherein the securing element further comprises a second actuating element and a securing part, wherein the second actuating element is engageable by a retracting breech block to enable the securing element to be moved to the first position and the securing part to be positioned outside of an active area of the securing device in the securing position.

18. The trigger apparatus as defined in claim 16, wherein the securing element comprises a first actuating element and a securing part, wherein the first actuating element is engageable by an advancing breech block to enable the securing element to be moved to the second position and to enable the securing part to be positioned adjacent to an active area of the securing device in the securing position.

* * * * *

UNITED STATES PATENT AND TRADEMARK OFFICE

CERTIFICATE OF CORRECTION

PATENT NO. : 8,117,779 B2
APPLICATION NO. : 12/771960
DATED : February 21, 2012
INVENTOR(S) : Doll et al.

It is certified that error appears in the above-identified patent and that said Letters Patent is hereby corrected as shown below:

In the Claims

In column 16, line 48 (claim 16), after "element is moveable" please delete "form" and add "from".

Signed and Sealed this
Ninth Day of April, 2013

Teresa Stanek Rea
*Acting Director of the United States Patent and Trademark Office*